United States Patent [19]

Howard, Jr.

[11] Patent Number: 4,850,493

[45] Date of Patent: Jul. 25, 1989

[54] BLOW MOLDED BOTTLE WITH SELF-SUPPORTING BASE REINFORCED BY HOLLOW RIBS

[75] Inventor: Carl R. Howard, Jr., Ypsilanti, Mich.

[73] Assignee: Hoover Universal, Inc., Ann Arbor, Mich.

[21] Appl. No.: 208,899

[22] Filed: Jun. 20, 1988

[51] Int. Cl.[4] ..... B65D 1/02

[52] U.S. Cl. ..... 215/1 C; 220/70

[58] Field of Search ..... 215/1 C; 220/69, 70, 220/72, 74

[56] References Cited

U.S. PATENT DOCUMENTS

| | | | |
|---|---|---|---|
| 3,403,804 | 10/1968 | Colombo | 215/1 C X |
| 3,598,270 | 8/1971 | Adomaitis et al. | 215/1 C |
| 3,871,541 | 3/1975 | Adomaitis | 220/70 X |
| 3,935,955 | 2/1976 | Das | 215/1 C |
| 4,108,324 | 8/1978 | Krishnakumar | 220/70 X |
| 4,249,667 | 2/1981 | Pocock et al. | 215/1 C |
| 4,342,398 | 8/1982 | Chang | 220/70 X |
| 4,403,706 | 9/1983 | Mahajan | 215/1 C |
| 4,525,401 | 6/1985 | Pocock et al. | 215/1 C X |
| 4,620,639 | 11/1986 | Yoshino | 220/70 X |

*Primary Examiner*—Sue A. Weaver

*Attorney, Agent, or Firm*—Harness, Dickey & Pierce

[57] ABSTRACT

A blow molded plastic container used in packaging of carbonated beverages having a hollow tubular body terminating at its lower end in an integral base. The base includes an arcuate wall projecting into the hollow interior of the tubular body. The arcuate wall terminates at a substantial concave ellipsoidal shaped top surface. A plurality of ribs are formed radially about the base between the arcuate and the tubular body to thus form a plurality of symmetrical feet which support the container in an upright stable position.

4 Claims, 1 Drawing Sheet

BLOW MOLDED BOTTLE WITH SELF-SUPPORTING BASE REINFORCED BY HOLLOW RIBS

BACKGROUND AND SUMMARY OF THE INVENTION

The present invention relates to hollow plastic containers and, more particularly, to blow molded plastic containers with self-supporting bases. The base has sufficient strength to withstand internal pressures like those encountered in the packaging of carbonated beverages and the like, and in addition has distinct supporting feet which enable the container to stand without rocking.

With the movement to plastic bottles for packaging carbonated beverages, the art has moved to plastic containers with self-supporting bases. Such a container must be able to withstand the internal pressure necessary to maintain the desired carbonation. Such a pressure is on the order of 75 p.s.i.

Several types of containers exist in the art that include integral bases with molded bottom configurations. These types of containers are illustrated in the following patents: U.S. Pat. Nos. 3,403,804, issued Oct. 1, 1968 to Colombo, entitled "Blown Bottle of Flexible Plastic"; 4,249,667, issued Feb. 10, 1981 to Pocock et al, entitled "Plastic Container with a Generally Hemispherical Bottom Wall Having Hollow Legs Projecting Therefrom"; 3,935,955, issued Feb. 3, 1976 to Das, entitled "Container Bottom Structure"; 4,108,324, issued Aug. 22, 1978 to Krishmakumar, et al, entitled "Ribbed Bottom Structure for Plastic Container"; 3,871,541, issued Mar. 18, 1975 to Adomaitis, entitled "Bottom Structure for Plastic Containers"; and 3,598,270, issued Aug. 20, 1971 to Adomaitis et al, entitled "Bottom End Structure for Plastic Containers". While these containers are known there still exists a need for a container of this type which requires a reasonable amount of material in the base, withstands internal pressures and will stand upright with out rocking.

The present invention provides the art with a container having a tubular body and an integral base, the junction of the two having a smooth, continuous exterior surface. The present invention eliminates any sharp bends deviations, or the like at the junction of the body and base. The present invention provides the container with good distribution of plastic throughout the container surface. Also, the present invention eliminates stress cracks and enables the use of a minimum amount of plastic material to mold the container. Also, when the container is full of a carbonated beverage or the like, the container will withstand the pressure necessary to maintain carbonation and will exhibit a very sturdy and rigid outer body. One the beverage has been removed from the container, the container is very flexible and enables the container to be discarded and the plastic re-cycled.

Accordingly, the present invention provides an improved blow molded plastic container having the above advantages. The container includes a hollow tubular body terminating at an integral base. The base includes a semi-toroidal shaped inner wall extending into the interior of the tubular body and terminating at a concave ellipsoidal shaped top surface. Outwardly of the inner wall, the container has a downwardly concave annular chamber bounded on the radially inner side by the inner wall of the base and one the radially outer side by the outer wall of the base. A plurality of ribs are formed radially about the base between the semi-toroidal inner wall and the outer wall of the base. Also, formed in the base in a plurality of feet arranged in a circular formation and symmetrical with respect to the container axis. The feet are formed between the ribs and have a wide dimension in a direction circumferentially of the base to provide firm support for the container when standing.

From the subsequent description and claims taken in conjunction with the accompanying drawings, other objects and advantages of the present invention will become apparent to those skilled in the art.

BREIF DESCRIPTION OF THE DRAWINGS

DETAILED DESCRIPTION OF THE PREFERRED EMBODIMENT

Figure 1:
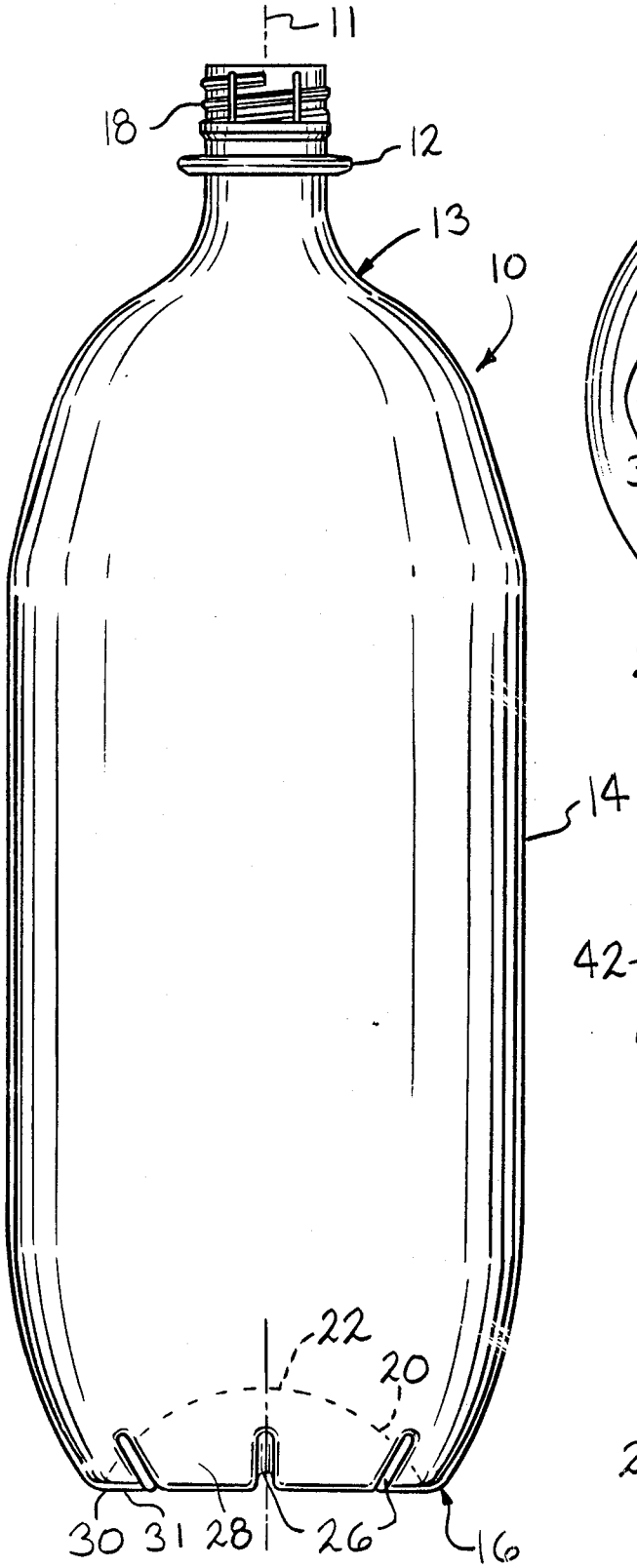
FIG. 1 is a side elevation view of a container in accordance with the present invention.

With reference to the drawing, the blow molded plastic container of this invention is illustrated and designated generally at 10 in FIG. 1. The container 10 includes an integral tapered top portion 13 which includes a flange 12 and a threaded neck 18. The container also has a hollow tubular body 14 and an integral base 16.

The tubular thin wall body 14 is manufactured, as is the entire container, from a blow molded plastic material such as polyethylene terephthalate (PET). The container 10 is similar to that of U.S. Patent application Ser. No. 07/209,004, filed June 20, 1988, entitled "Blow Molded Container with Self-Supporting Base", assigned to the assignee of the present application, the specification of which is herein incorporation by reference.

The base 16 includes an annular inner wall 20 with a concave ellipsoidal top wall 22 projecting into the interior of the tubular body 14. Outwardly of the inner wall 20, the container 10 has a downwardly concave annular chamber 23 bounded on the radially inner side by the wall 20 and on the radially outer side by the outer wall 25 (FIG. 3) of the base 16. A plurality of internal ribs 26 are formed in the base 16 between the walls 20 and 25, the ribs 26 being symmetrical relative to the longitudinal axis 11 of the container 10. A plurality of feet 28 are formed between adjacent ribs 26 to enable the container 10 to stand upright.

Figure 2:
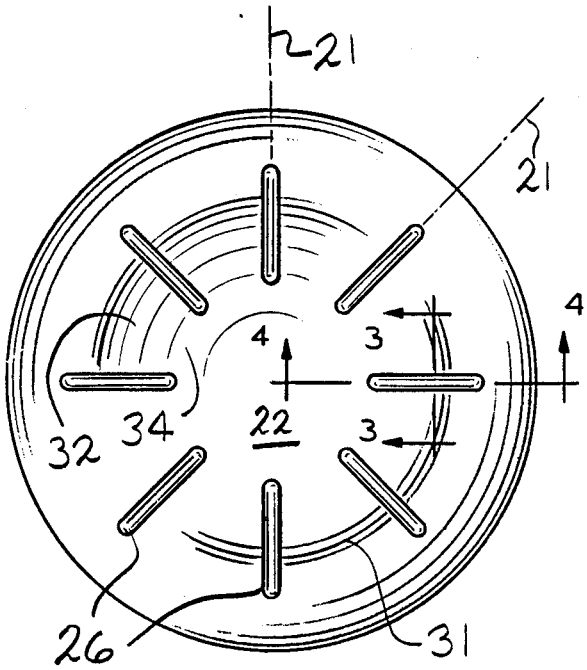
FIG. 2 is a bottom plan view of the container in FIG. 1.

The base 16 forms a rounded bottom 30 at the junction of the walls 20 and 25. The bottom 30 includes the line of contact 31 which the container 10 makes with a supporting surface. The rounded bottom 30 is integral with a first semi-spherical shaped inner wall section 32 of the annular inner wall 20. The concave semi-spherical wall section 32 enables the bottom 30 to have an overall circular appearance, as seen in FIG. 2. The concave semi-spherical inner wall section 32 is integral with an arcuate inner wall section 34. the arcuate inner wall section 34 is a second portion of the annular inner wall 20. The arcuate inner wall section 34 is integral with the ellipsoidal top 22, as seen in FIGS. 2 and 4.

Figure 3:
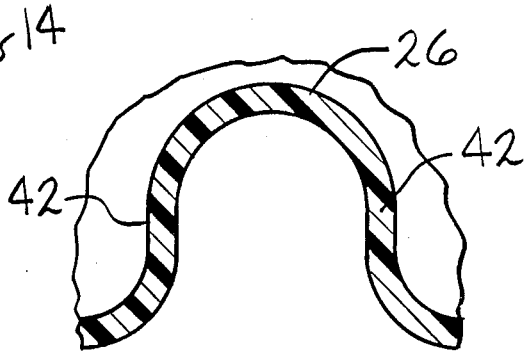
FIG. 3 is a cross-section view of FIG. 2 along line 3—3 thereof.
Figure 4:
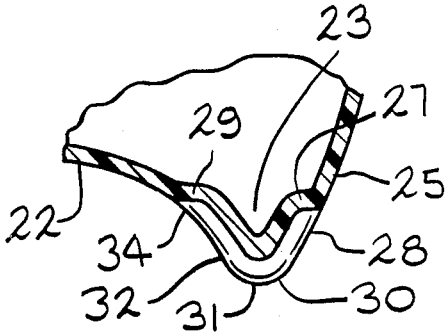
FIG. 4 is a cross-section view of FIG. 2 along line 4—4 thereof.

The internal ribs 26 are formed by elongated indentations formed on the surface of the base 16, as seen in FIGS. 2–4, so that the ribs 26 extend radially off the base 16. The positioning of the ribs 26 is such that the ribs 26 are on radii about 30° to 60° apart and preferably about 45° apart, about the circular base. The indentations, as well as the ribs, are positioned below the apex of the ellipsoidal top wall 22.

The ribs 26 are generally flattened V-shape in cross-section when viewed along the longitudinal axes 21 of the ribs 26, as seen in FIG. 4. The ends 27 and 29 of the "V"s are arced and integral with outer wall 25 and arcuate inner wall section 34. The "V" end 29 extends toward the ellipsoidal top wall 22 on the annular inner wall 20, a distance slightly greater than the extension of the "V" end 27 on the outer wall 23.

The ribs 26 are generally inverted U-shaped in cross-section when viewed transverse to the longitudinal axes 21 of the ribs 26, as seen in FIG. 3. The ribs 26 are of substantially the same height and are of small height so that they are positioned below the apex of the ellipsoidal top wall 22. The positioning of the ribs 26 below the apex of the ellipsoidal top wall 22 enhances the strength of the container base 16. Also, it provides the container 10 with additional support.

The feet 28 includes the rounded bottom 30 which includes the line of contact 31. Generally, the line of contact 31 is aligned below the intersection of the rounded "V", as seen in FIG. 4. The feet 28 support the container 10 such that the container 10 stands level and is resistive to incidental tipping. The feet 28 also include arcuate side walls 42 that form the legs of the rounded inverted U-shaped indentation of the ribs 26.

While the above discloses the preferred embodiment of the present invention, it will become apparent to those skilled in the art that modifications, variations and alterations may be made to the present invention without deviating from the scope and fair meaning of the subjoined claims.

What is claimed is:

1. A container comprising an upright hollow tubular body having an upright longitudinal axis and a side wall terminating at its lower end in an integral aligned base which closes the lower end of the side wall, the outer surface of the base having an upwardly concave surface located centrally of the base and a convex bottom surface of annular shape surrounding the concave central surface and merging therewith and with said side wall at the lower end thereof, the lowermost points of said convex bottom surface lying in a common plane, said upwardly concave surface projecting upwardly into the interior of the tubular body from said convex bottom surface and having an apex centrally thereof, a plurality of indentations on the convex body surface forming a plurality of hollow ribs extending upwardly and interrupting said convex bottom surface, said ribs being substantially symmetrical with respect to said axis and extending radially with respect to said axis, said ribs being positioned substantially below the apex of said concave surface and spaced a small distance upwardly from said bottom surface relative to said apex, and said bottom surface between said ribs forming a plurality of container support feet, said ribs and feet being proportioned in a direction circumferentially of said bottom surface so that said ribs are narrow and said feed at substantially wider than said ribs throughout their length to provide firm support of said container on said feet when standing on a horizontal surface, said ribs providing also for symmetrical arrangement of said feet to thereby assure a balance support of said container on said feet.

2. The container according to claim 1 wherein said feet formed between adjacent ribs have rounded sides and bottoms providing the container with a smooth continuous outer surface.

3. The container according to claim 1 wherein said ribs are generally V-shaped when viewed along their longitudinal axes.

4. The container according to claim 3 wherein said ribs are substantially parallel to said convex bottom surface when viewed along their longitudinal axes.

* * * * *

UNITED STATES PATENT AND TRADEMARK OFFICE

CERTIFICATE OF CORRECTION

PATENT NO. : 4,850,493

DATED : July 25, 1989

INVENTOR(S) : Carl R. Howard, Jr.

It is certified that error appears in the above-identified patent and that said Letters Patent is hereby corrected as shown below:

Title page, item [57],
Abstract, Line 8, after "arcuate" insert --wall--.

Column 1, Line 55, "One" should be --Once--.
Column 1, Line 68, "one" should be --on--.
Column 2, Line 4, "in" (second occurrence) should be --is--.
Column 2, Line 23, ";" should be --.--.
Column 2, Line 42, "incorporation" should be --incorporated--.
Column 2, Line 65, "the" should be --The--.
Column 3, Line 27, "includes" should be --include--.
Column 4, Line 14, "body" should be --bottom--.
Column 4, Line 26, "feed at" should be --feet are--.

Signed and Sealed this

Eleventh Day of December, 1990

*Attest:*

HARRY F. MANBECK, JR.

*Attesting Officer*

*Commissioner of Patents and Trademarks*